US007049561B1

(12) United States Patent
Lin

(10) Patent No.: US 7,049,561 B1
(45) Date of Patent: May 23, 2006

(54) FAR INFRARED TUBULAR POROUS CERAMIC HEATING ELEMENT

(76) Inventor: Cheng Ping Lin, 5th FL., No.26,Sec.3, Ren-ai Rd., Taipei (TW)

( * ) Notice: Subject to any disclaimer, the term of this patent is extended or adjusted under 35 U.S.C. 154(b) by 0 days.

(21) Appl. No.: 11/037,233

(22) Filed: Jan. 19, 2005

(51) Int. Cl.
*H05B 3/10* (2006.01)

(52) U.S. Cl. ..... 219/553; 219/552; 264/431; 264/273; 264/267; 156/64; 156/89.22; 156/25.3; 428/138; 428/188; 428/116

(58) Field of Classification Search ..... 219/553, 219/552; 264/431, 273, 267, 275; 156/64, 156/89.22, 25.3; 428/138, 188, 116–117
See application file for complete search history.

(56) References Cited

U.S. PATENT DOCUMENTS 5,399,841 A * 3/1995 Abe et al. ..... 219/552

* cited by examiner

*Primary Examiner*—Shawntina Fuqua
(74) *Attorney, Agent, or Firm*—Dennison, Schultz, Dougherty & MacDonald

(57) ABSTRACT

A far infrared tubular porous ceramic heating element which is suitable for various kinds of catalyst, heater and electric conductor . . . etc. Inside the body, a plurality of via holes is formed, and the crossing portions of the walls of via holes are formed in arc shape so as to prevent breaking and disturbance to heat flow.

3 Claims, 6 Drawing Sheets

FAR INFRARED TUBULAR POROUS CERAMIC HEATING ELEMENT

BACKGROUND OF THE INVENTION

1. Field of the Invention

The present invention relates to a far infrared tubular porous ceramic heating element, especially to a heating element which is suitable for various kinds of catalyst, heater and electric conductor . . . etc. Inside the body, a plurality of via holes is formed, and the crossing portions of the walls of via holes are formed in arc shape so as to prevent breaking and disturbance to heat flow.

2. Description of the Prior Art

It is known to public that the porous ceramic carriers are widely applied as catalyst carriers (such as deodorizer, infrared catalyst . . . etc. so as to promote chemical reaction or reduction), heating elements or electric conductors. In view of the heating elements, to compare with the traditional electric heating wires, because it is not necessary for the porous ceramic carriers to perform two times of heat transmission and heat conduction, it then has advantages of rapid heating, uniform heating, high security and high heating efficiency.

As shown in FIG. 1, conventional porous ceramic heating element comprises mainly a body 1 formed by solid molding, and a plurality of via holes 10 penetrate the body 1. The body 1 can be made in the shapes of square, circle etc, while the surfaces of via holes 10 are used as the implantation beds for various functional materials to adhere with. Because the crossing portions of the walls of the via holes are formed in acute angle 12, this acute angle 12 would deposit fluids and generate stress. The body of ceramic heating element often causes broken at the crossing portions. This is the biggest disadvantage of conventional porous ceramic heating element.

SUMMARY OF THE INVENTION

Accordingly, the present invention has been made to solve the above-mentioned problems occurring in the prior art and an object of the present invention is to provide a far infrared tubular porous ceramic heating element, which includes a body formed by solid molding, and a plurality of via holes penetrate the body. Wherein the crossing portions of the walls of via holes are formed in arc shape, so as to eliminate the acute angles formed in the via holes, then the stress would be reduced and the broken happened at the crossing portions of the walls are prevented.

Another object of the present invention is to provide a far infrared tubular porous ceramic heating element on the surface of the body, an electric heating layer is coated, and two electrodes are provided at the ends of the electric heating layer. Whereas, said electrodes are formed in parallel to the axis of body.

BRIEF DESCRIPTION OF THE DRAWINGS

The accompanying drawing, which is included to provide a further understanding of the invention, and incorporated in and constitute a part of this specification, illustrate embodiments of the invention and together with the description serve to explain the principles of the invention, wherein.

DETAILED DESCRIPTION OF THE PREFERRED EMBODIMENTS

Hereinafter, a preferred embodiment of the present invention will be described with reference to the accompanying drawings.

Figure 1:
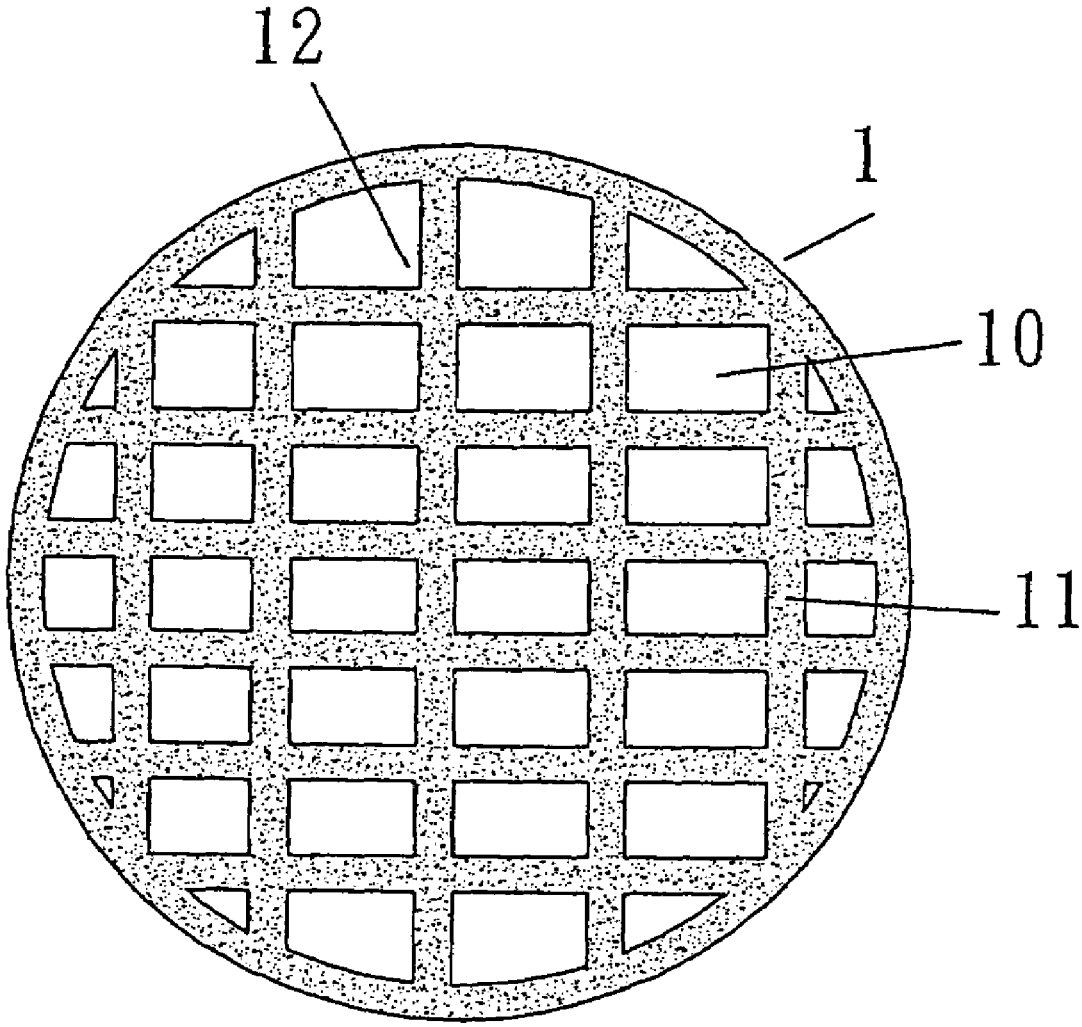
FIG. 1 PRIOR ART
FIG. 1 is a cross-sectional view showing a conventional porous ceramic carrier.
Figure 2:
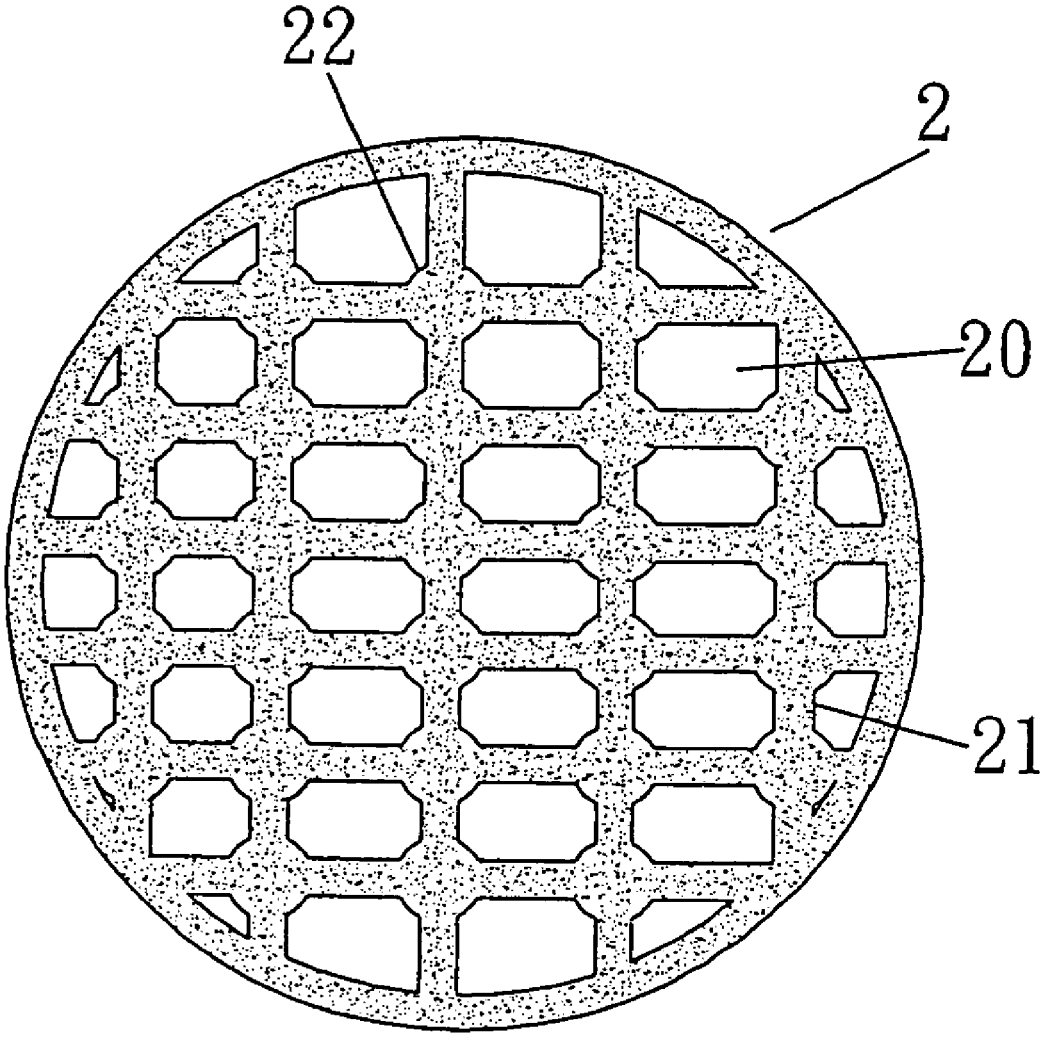
FIG. 2 is a cross-sectional view of the present invention.
Figure 3:
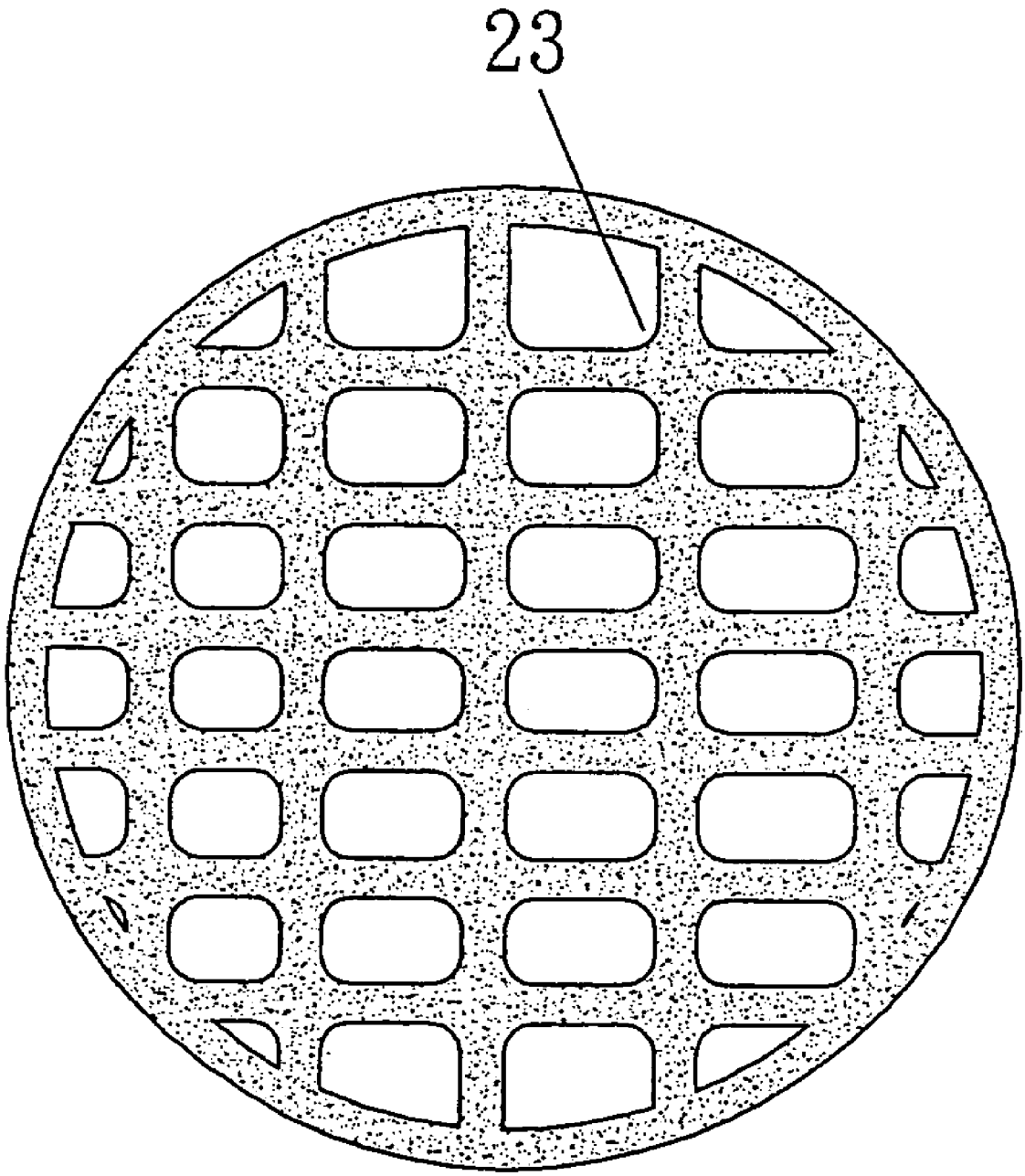
FIG. 3 is a cross-sectional view showing the second preferred embodiment of present invention.

Please refer to FIG. 2, it is shown that the far infrared tubular porous ceramic heating element of present invention includes a body 2, the body 2 is obtained by solid molding to form a tubular body having a plurality of via holes 20 inside it. The body 2 can be formed as circular tube, tetragonal tube . . . etc. The surface of via hole 20 inside the body can be used as implantation beds for adherence of functional materials. And the crossing portions of walls 21 forming the via holes are formed in arc shape. It can be formed as convex column 22, or formed in concaved surface 23 (as shown in FIG. 3). Such that the inner portions of via holes 20 would not form the acute angle. Thus, in using the present invention, the generation of stress would be reduced, and it will present the broken of walls 21 at the crossing portions. Then the object of present invention will be achieved. The present invention then can be deemed as a creation of practical uses.

Figure 4:
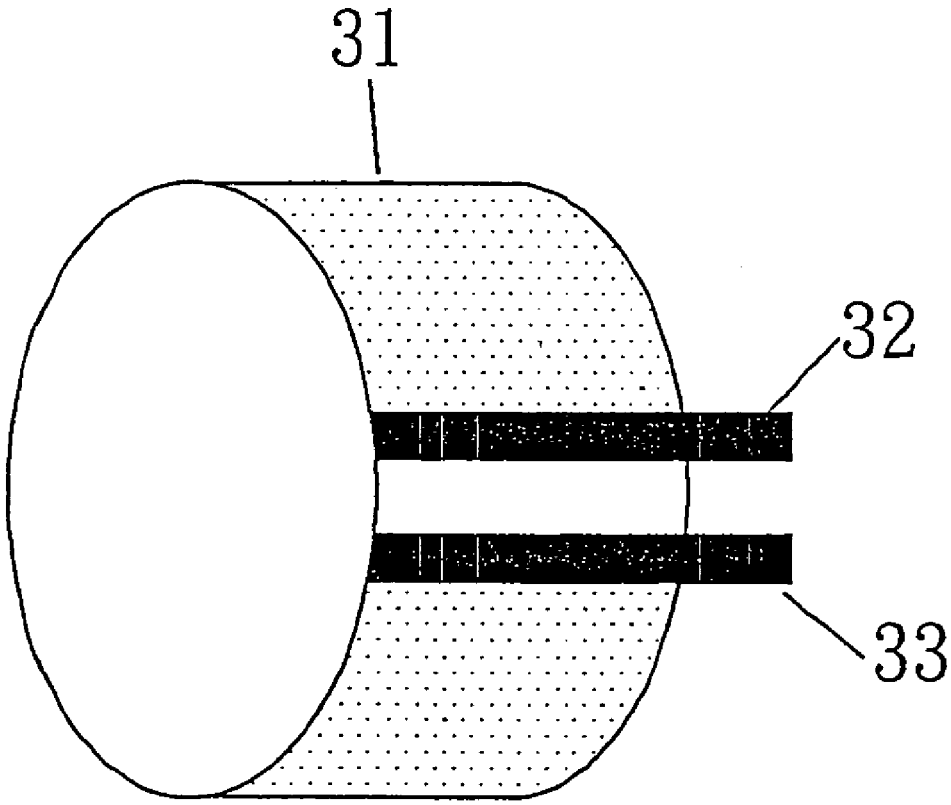
FIG. 4 is a cross-sectional view showing the third preferred embodiment of present invention.

Furthermore, as shown in FIG. 4, the outer surface of the far infrared tubular porous ceramic heating element of present invention is coated with electric heating layer 31, each of the two ends of the electric heating layer 31 are respectively forms an electrode 32/33. The electrodes 32, 33 are extended along with the direction parallel to the axis of heating element. By conducting electricity into the electrodes 32, 33, the whole body of the element can reach a better condition of heating.

Figure 5:
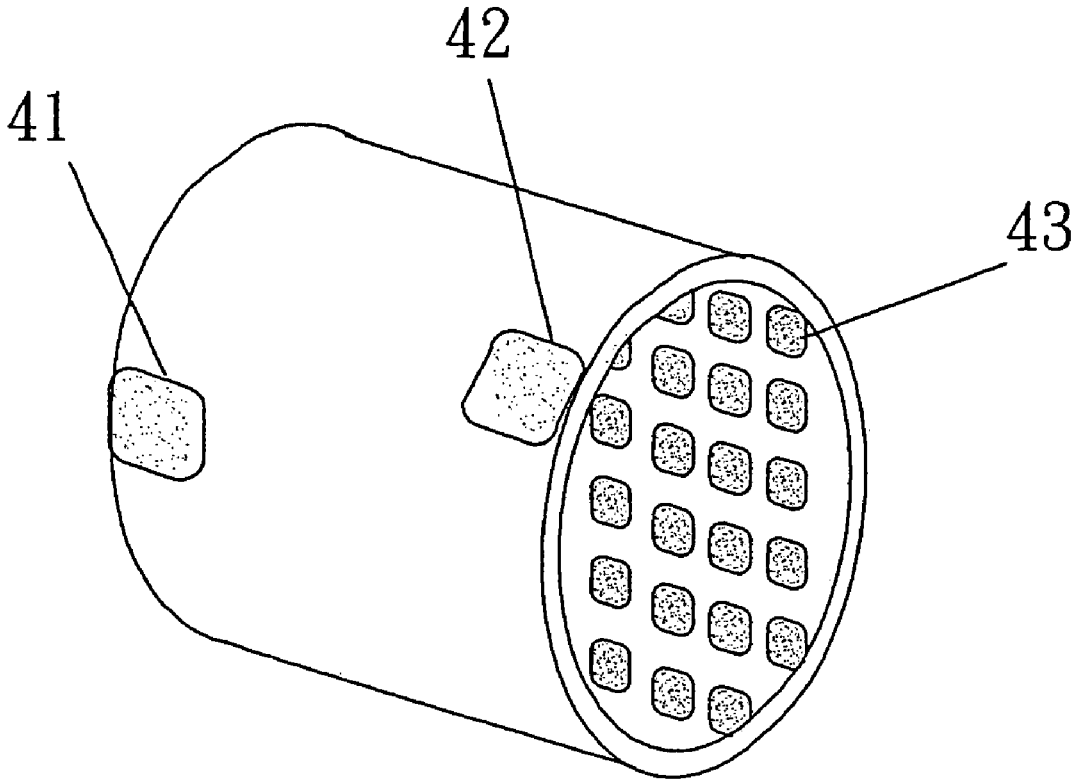
FIG. 5 is a cross-sectional view showing the fourth preferred embodiment of present invention.

In addition, as shown in FIG. 5, in the far infrared tubular porous ceramic heating element of present invention, the electrodes 41, 42 can be formed on the inner sides of the outer edges of heating body 2, while the heating layer 43 is formed on the inner wall of via holes.

Figure 6:
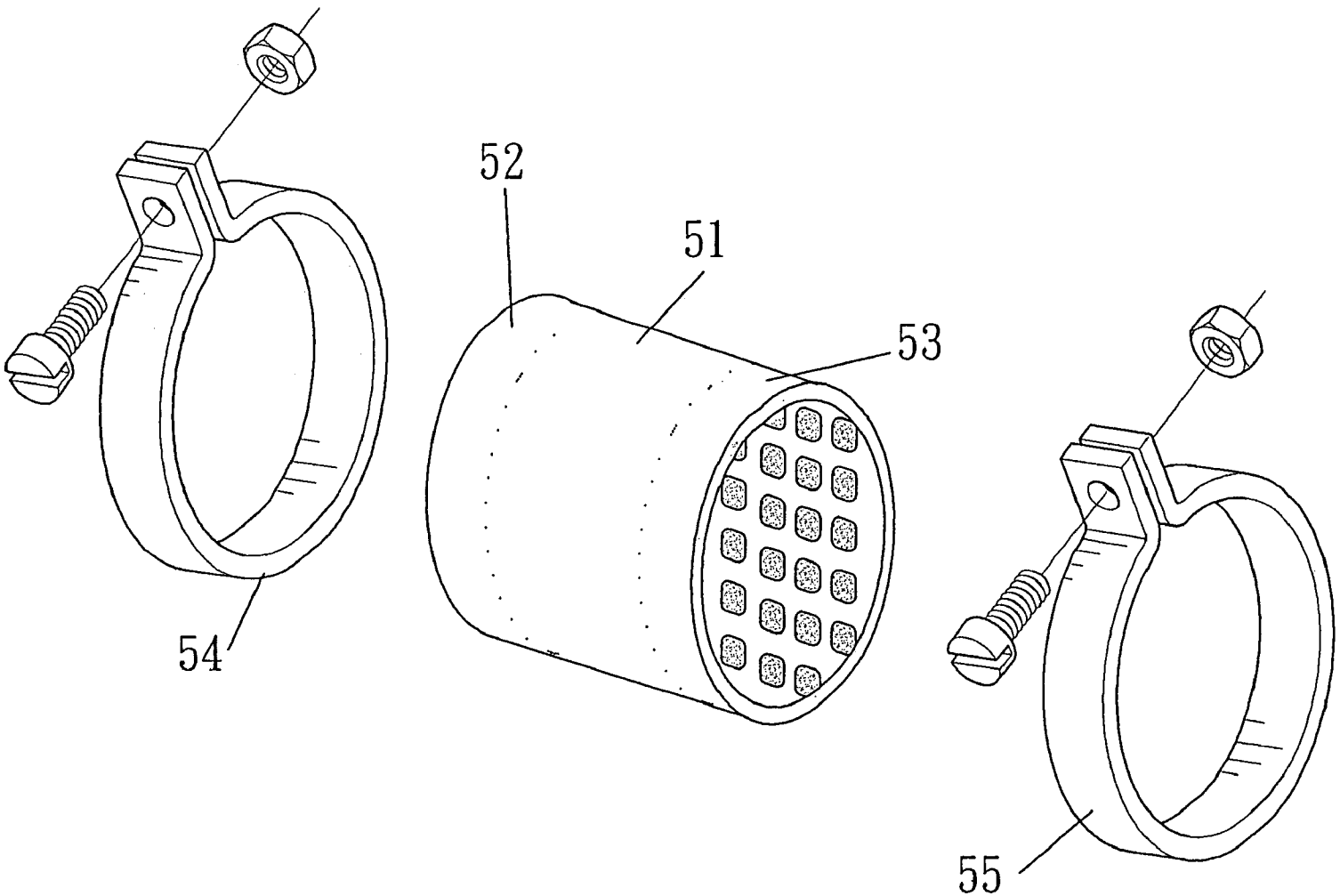
FIG. 6 is a cross-sectional view showing the fifth preferred embodiment of present invention.

Besides, as shown in FIG. 6, in the far infrared tubular porous ceramic heating element of present invention, the two ends of the outside of healing body 51 are respectively provided with electrode fixing area 52. 53. And, the electrode fixing areas 52. 53 are respectively locked with metal rings 54. 55 as electrode connectors.

In conclusion from the above, the far infrared tubular porous ceramic heating element of present invention can get rid of the disadvantages happened in conventional technique, and achieve the object of present invention. It is new and does not have seen in publication opened to public, it then complies with conditions of approvable patents.

Other embodiments of the present invention will become obvious to those skilled in the art in light of above disclosure. It is of course also understood that the scope of the present invention is not to be determined by the foregoing description, but only by the following claims.

What is claimed is:

1. A far infrared tubular porous ceramic heating element comprising:

a body and a plurality of via holes penetrating the interior portion of the body, the surface of the via holes can be used as the implantation beds for various functional materials to adhere with, characterized in that:

the crossing portions of the walls of the via holes are formed in arc shapes, as to eliminate the acute angles formed in conventional via holes to thereby reduce stress and breaking at the crossing portion of the walls, and wherein the outer surface of said body is coated with an electric heating layer, and each of the two ends of the electric heating layer form an electrode and the electrodes are extended along the direction parallel to the axis of the heating element.

2. The far infrared tubular porous ceramic heating element as claimed in claim 1, wherein the electrodes are formed on the inner sides of the outer edges of heating body, and the heating layer is formed on the inner wall of via holes.

3. The far infrared tubular porous ceramic heating element as claimed in claim 2, wherein the two ends of the outside of heating body are respectively provided with electrode fixing area, and the electrode fixing areas are respectively locked with metal rings as electrode connectors.

* * * * *